US008029381B2

(12) United States Patent
Papa, Jr.

(10) Patent No.: US 8,029,381 B2
(45) Date of Patent: Oct. 4, 2011

(54) DEVICE FOR IMPROVING A GOLF SWING

(75) Inventor: Carl Papa, Jr., Knoxville, TN (US)

(73) Assignee: Carl Papa, Jr., Knoxville, TN (US)

( * ) Notice: Subject to any disclaimer, the term of this patent is extended or adjusted under 35 U.S.C. 154(b) by 0 days.

(21) Appl. No.: 12/858,084

(22) Filed: Aug. 17, 2010

(65) Prior Publication Data

US 2010/0311516 A1 Dec. 9, 2010

Related U.S. Application Data

(63) Continuation-in-part of application No. 12/356,127, filed on Jan. 20, 2009, now Pat. No. 7,905,796.

(51) Int. Cl.
*A63B 69/36* (2006.01)

(52) U.S. Cl. ..... 473/269; 473/218

(58) Field of Classification Search ..... 473/269–271, 473/266, 218
See application file for complete search history.

(56) References Cited

U.S. PATENT DOCUMENTS

| | | | | | |
|---|---|---|---|---|---|
| 3,413,006 | A * | 11/1968 | Beston | 473/269 |
| 3,994,501 | A * | 11/1976 | O'Donnell | 473/269 |
| 4,023,810 | A * | 5/1977 | Lorang | 473/218 |
| 4,037,847 | A * | 7/1977 | Lorang | 473/269 |
| 4,304,406 | A * | 12/1981 | Cromarty | 473/225 |
| 4,577,868 | A * | 3/1986 | Kiyonaga | 473/269 |
| 5,419,562 | A * | 5/1995 | Cromarty | 473/269 |
| 5,916,036 | A * | 6/1999 | Hamilton | 473/269 |
| 2008/0318703 | A1 * | 12/2008 | Mooney | 473/269 |

* cited by examiner

*Primary Examiner* — Raleigh W. Chiu
(74) *Attorney, Agent, or Firm* — Pitts, Lake & Bell, P.C.

(57) ABSTRACT

Described is a portable and intuitive golf swing improvement device for indicating the proper shift of a golfer's body weight to the front foot during a down swing. More specifically, the swing improvement device measures the shift of the golfer's body weight during a golf swing and indicates when such shift is in accordance with a technically sound swing. Additionally, the swing improvement device is self-sufficient and portable such that the device is deployable almost anywhere. The swing improvement device also provides swing analysis in a manner that is immediately understandable to the golfer.

7 Claims, 14 Drawing Sheets

DEVICE FOR IMPROVING A GOLF SWING

CROSS-REFERENCE TO RELATED APPLICATIONS

The present application claims priority to and is a continuation-in-part of application Ser. No. 12/356,127 filed on Jan. 20, 2009, the contents of which are incorporated by reference herein in their entirety.

STATEMENT REGARDING FEDERALLY SPONSORED RESEARCH OR DEVELOPMENT

Not Applicable

BACKGROUND OF THE INVENTION

1. Field of the Invention

This invention pertains to a device for improving a golf swing. More particularly, this invention pertains to a device for indicating the proper shift of a golfer's body weight during the down swing and follow-through of a golf swing.

2. Description of the Related Art

Many golfers, both amateur and professional, are constantly in search of a consistent and technically sound golf swing. One essential component of a technically sound golf swing is the shift of the golfer's body weight to the front foot during the golfer's down swing. As a result, a device that measures this shift of body weight to the front foot would assist in improving a golfer's swing. Many conventional devices measure this shift in body weight using various methods and measurement components and configurations. However, the complexity of these conventional devices requires cumbersome equipment, intricate set-up and operation procedures, extensive signal processing, and complicated data analysis. The cumbersome equipment limits the portability of these conventional devices and the locations at which they can be used. In fact, some conventional devices can only be moved by machine. Additionally, the intricate set-up and operation of these conventional devices limit when the devices can be used. For example, some of these conventional devices require professional instillation, set-up, and operation. The extensive signal processing performed by some of these conventional devices requires an independent computer. This further limits the location at which the devices can be used and requires the purchase of additional equipment. Additionally, the complicated data analysis displayed by some of these conventional devices is cryptic for the average golfer. As a result, one must be trained to read and understand the resulting data analysis of these conventional devices or depend on another for interpretation. Consequently, a device that intuitively indicates the proper shift of a golfer's body weight during a down swing, that is easily operated, and that is portable is desired.

BRIEF SUMMARY OF THE INVENTION

In accordance with the various features of the present invention, there is provided a portable and intuitive golf swing improvement device for indicating the proper shift of a golfer's body weight to the front foot during a technically sound down swing. The swing improvement device includes a mat, a pressure switch, an indicator, a mat securing apparatus, and a transportation apparatus. The mat is sufficiently large such that the golfer is able to take a golfer's stance on the mat. The pressure switch is disposed at the mat such that when the golfer takes a stance on the mat, the golfer's front foot is positioned on the pressure switch. The pressure switch is movable between an open position and a closed position and is biased to the open position by, for example, a spring. The force of the golfer's front foot against said pressure switch is sufficient to overcome the bias when the golfer shifts its body weight to the front foot in accordance with a technically sound down swing. Accordingly, when the pressure switch moves to the closed position, the indicator generates an indication that is perceivable by the golfer or another, such as an instructor. As a result, when the golfer performs a technically sound golf swing, the indicator generates the indication, which alerts the golfer of a proper swing.

The mat is capable of a portable position, such as a rolled position. The mat securing apparatus is adapted to cooperate with the mat to maintain the mat at this portable position. The transportation apparatus is secured to the mat such that the swing improvement device can be carried by way of the transportation apparatus. For example, the device can be carried over the shoulder of the golfer or attached to the golfer's bag.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

The present invention provides a portable and intuitive golf swing improvement device for indicating the proper shift of a golfer's body weight to the front foot during a technically sound down swing. More specifically, the swing improvement device measures the shift of the golfer's body weight during a golf swing and indicates when such shift is in accordance with a technically sound swing. Additionally, the swing improvement device is self-sufficient and portable such that the device is deployable almost anywhere. The swing improvement device also provides swing analysis in a manner that is immediately understandable to the golfer. One embodiment of the golf swing improvement device constructed in accordance with the various features of the present invention is illustrated generally at 10 in FIG. 1.

Figure 2:
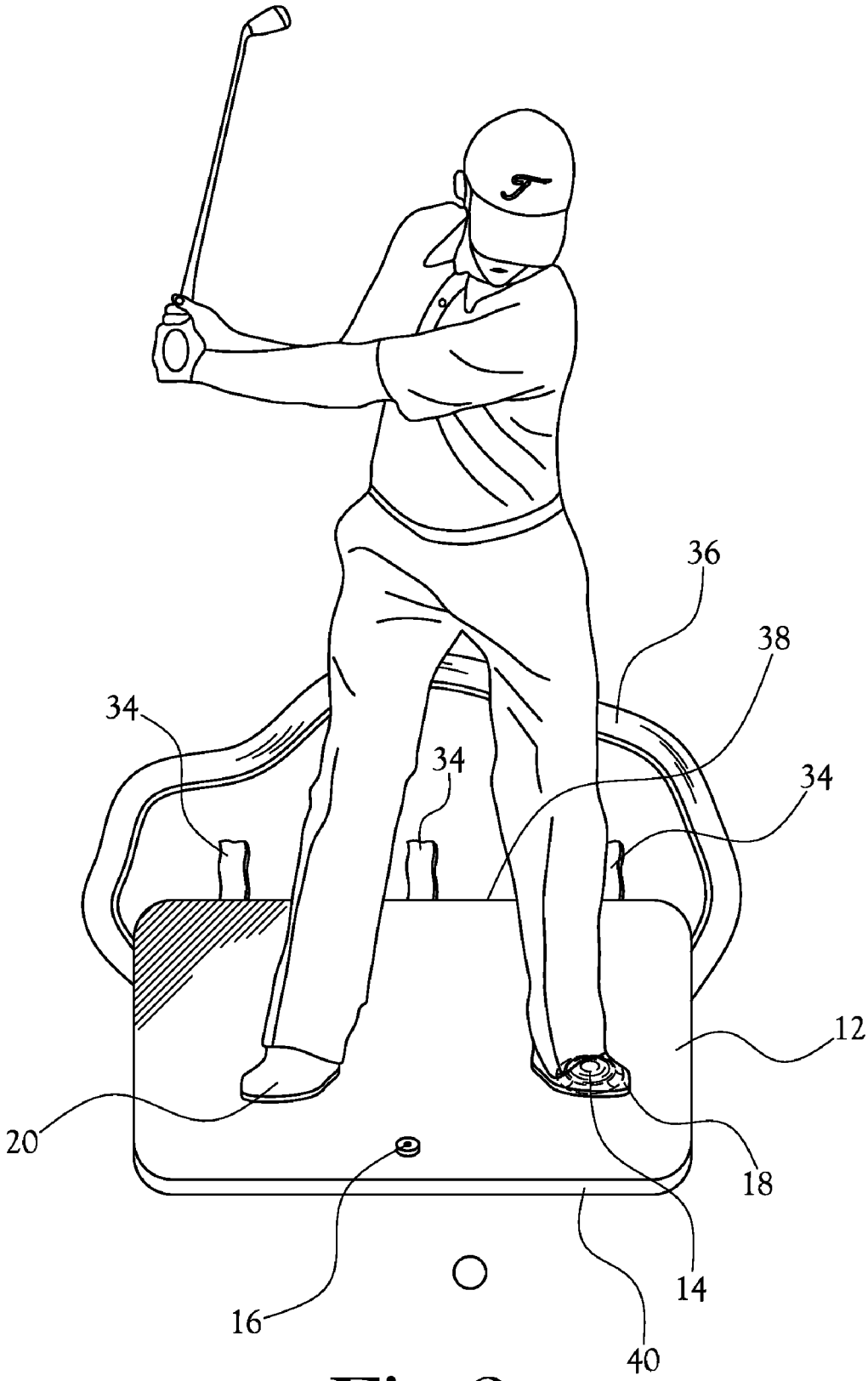
FIG. 2 illustrates a golfer performing a golf swing on the swing improvement device of FIG. 1.

The golf swing improvement device 10 includes a mat 12, a pressure switch 14, and an indicator 16. In the illustrated embodiment, the mat 12 is sufficiently large such that a golfer taking a golfer's stance is able to stand with both feet on the mat 12, as is illustrated at FIG. 2. A golfer's stance is the stance a golfer takes when initiating the swing of a golf club. The pressure switch 14 is disposed at the mat 12 such that the golfer's front foot 18 is positioned on the pressure switch 14 when the golfer takes a stance on the mat 12. The golfer's front foot 18 is the foot in the direction of a golf swing. More specifically, when the golfer swings right handed, as illustrated at FIG. 2, the front foot 18 is the golfer's left foot, and the back foot 20 is the golfer's right foot. Accordingly, when the golfer swings left handed, the front foot 18 is the golfer's right foot, and the back foot 20 is the golfer's left foot.

Figure 1:
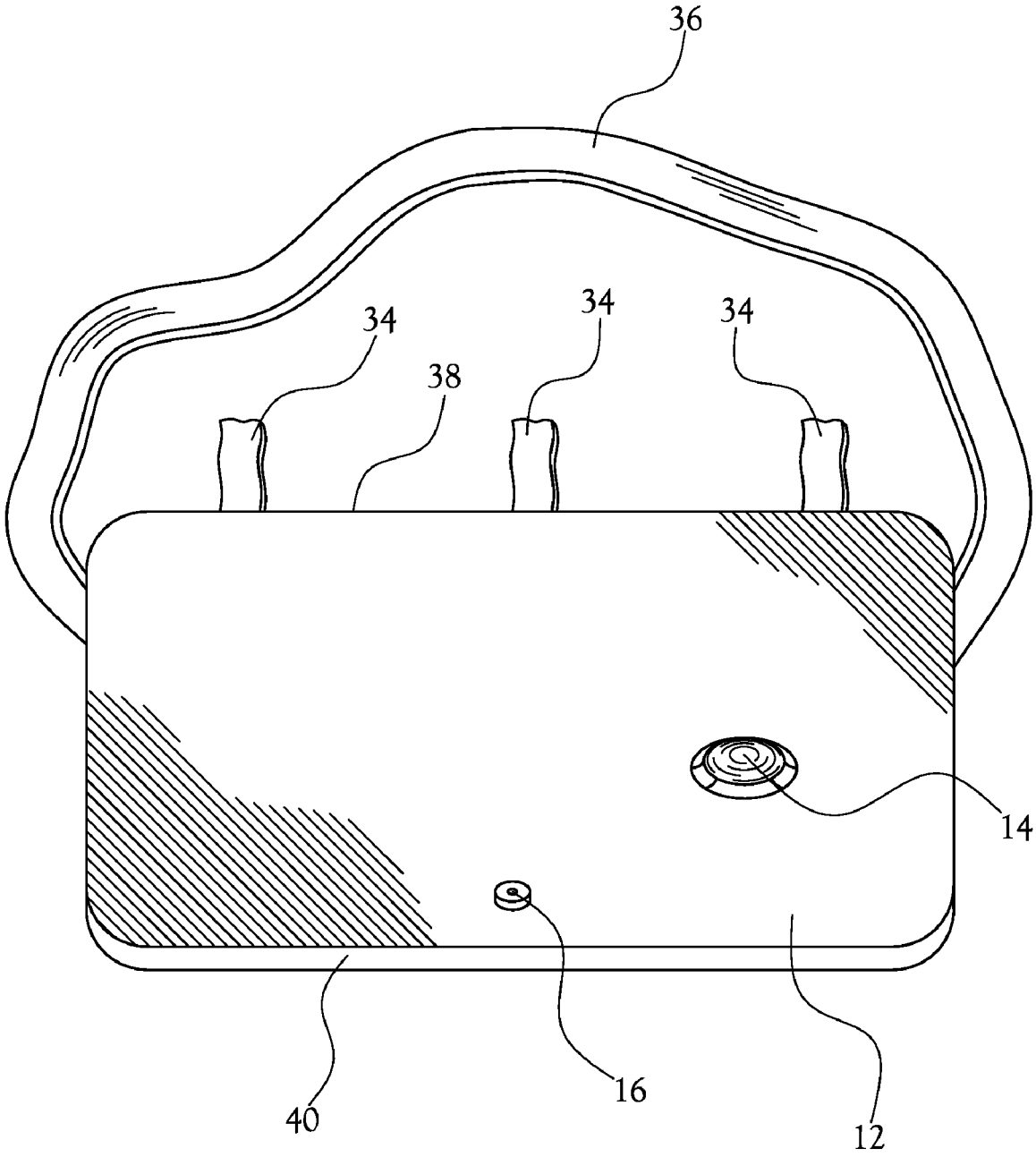
FIG. 1 illustrates one embodiment of the golf swing improvement device in accordance with the various features of the present invention.
Figure 3:
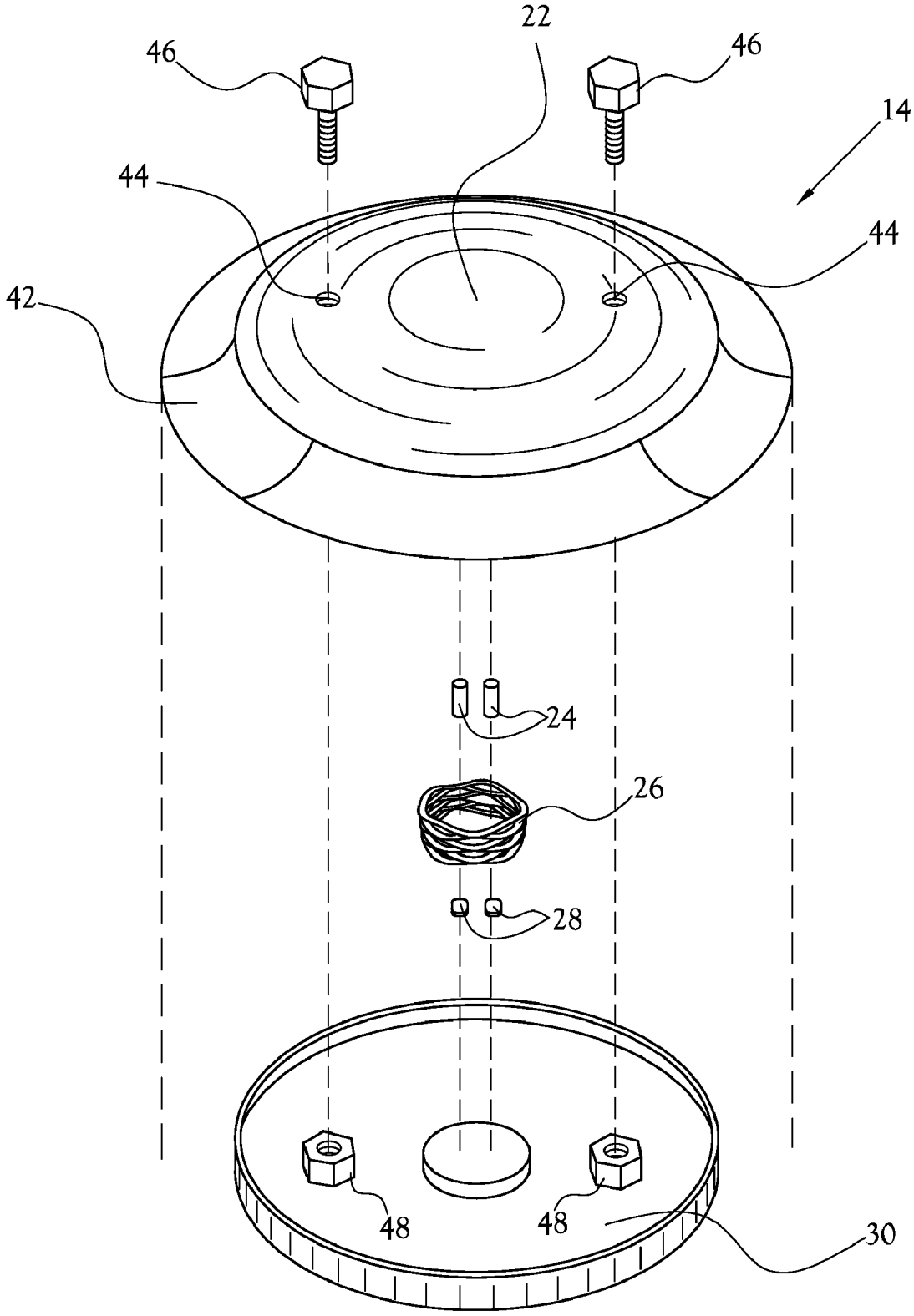
FIG. 3 is an exploded view of one embodiment of the pressure switch having a dome-type housing.

FIG. 3 illustrates an exploded view of one embodiment of the pressure switch 14 in accordance with the various features of the present invention. The pressure switch 14 includes an upper housing member 22, a pair of electrodes 24, a biasing spring 26, a pair of electrical contacts 28, and a lower housing member 30. The pressure switch 14 is capable of an open position and a closed position. When the pressure switch 14 is at the open position, the electrodes 24 and the electrical contacts 28 are not in electrical communication. Conversely, when the pressure switch 14 is at the closed position, each of the electrodes 24 is in electrical communication with a respective one of the electrical contacts 28. The pressure switch 14 is biased to the open position by way of the biasing spring 26. More specifically, in the illustrated embodiment, the electrodes 24 are mechanically secured to the under side of the upper housing member 22 such that the electrodes 24 extend from the upper housing member 22 in the direction of the lower housing member 30. Accordingly, the electrical contacts 28 are mechanically secured to the upper side of the lower housing member 30 such that each electrical contact 28 is spatially aligned with a respective electrode 24. The biasing spring 26 mechanically engages the upper housing member 22 and the lower housing member 30 such that the biasing spring 26 biases the pressure switch 14 to the open position. When the swing improvement device 10 is deployed, as illustrated at FIGS. 1 and 2, the lower housing member 30 is positioned against the ground, either directly or by way of the mat 12. As a result, to move the pressure switch 14 to the closed position, a force must be applied to the upper housing member 22, whereby the force is sufficient to overcome the biasing force generated by the biasing spring 26. The biasing force generated by the biasing spring 26 is defined subsequently.

In the illustrated embodiment, the biasing spring 26 is a wave spring. A wave spring permits the pressure switch 14 to have a low profile such that the pressure switch 14, despite being positioned under the golfer's front foot 18, does not affect the golfer's swing. Additionally, a wave spring provides a more consistent and reliable biasing force against forces that are not parallel with the longitudinal axis of the biasing spring 26. For example, when the golfer swings a club, the front foot 18 shifts laterally such that forces unparallel with the longitudinal axis of the biasing spring 26 are applied against the biasing spring 26. However, it should be noted that the biasing spring 26 can be a spring other than a wave spring without departing from the scope or spirit of the present invention.

Figure 4:
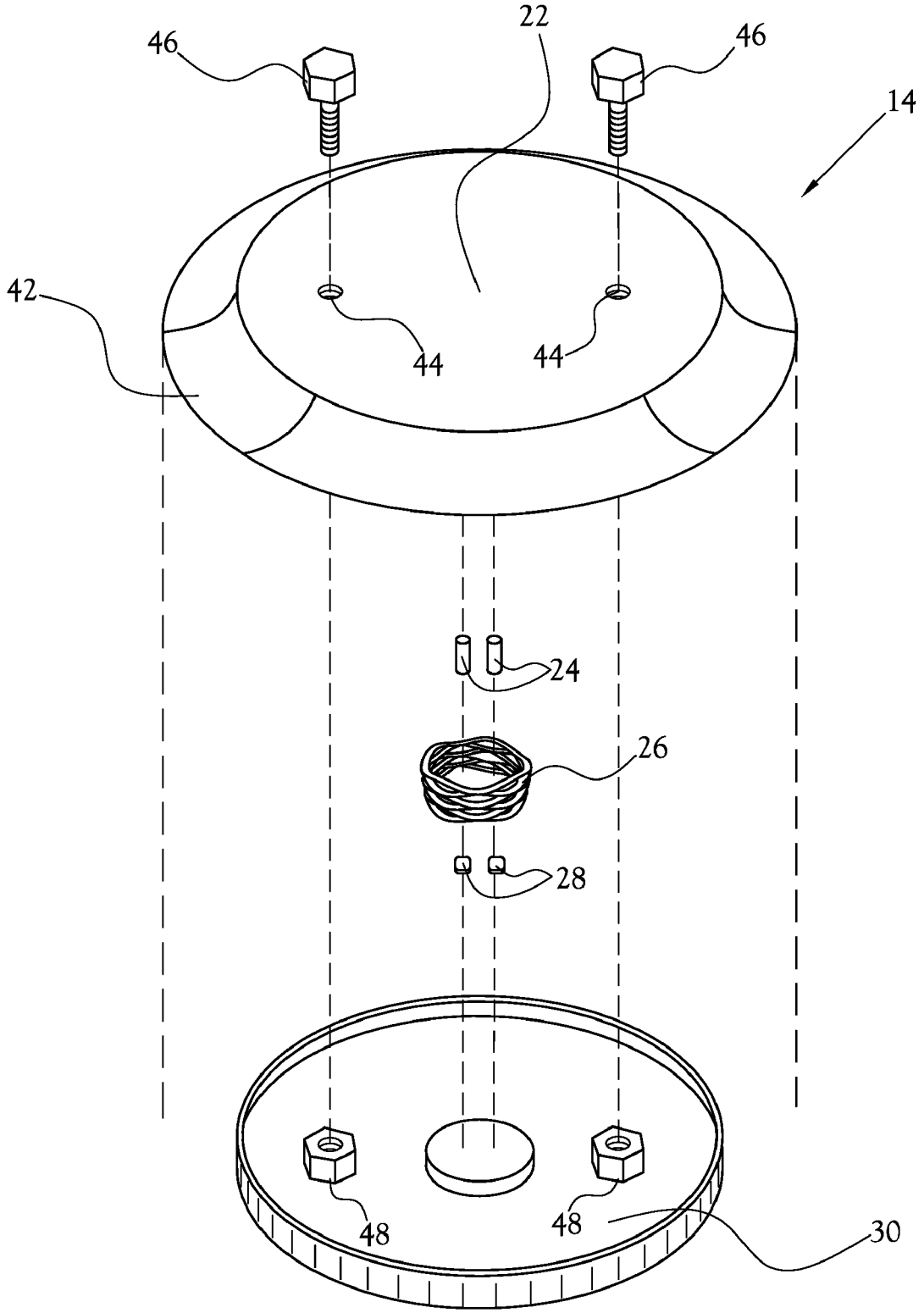
FIG. 4 is an alternate embodiment of the pressure switch having a flat housing.

Also, in the illustrated embodiment, the upper side of the upper housing member 22 has a dome-type contour such that the pressure switch 14 does not restrict the movement of the golfer's front foot 18 during the course of a swing. Instead, the contour of the upper housing member 22 permits the golfer's front foot 18 to pivot in accordance with a technically sound swing. Additionally, in the illustrated embodiment, the upper housing member 22 includes a shoulder 42 that extends beyond the perimeter of the lower housing member 30 and slopes gradually toward the lower housing member 30. This configuration permits the pressure switch 14 to be moved to the closed position without the housing members 22 and 30 restricting such movement and provides protection against environmental elements to the components of the switch 14. It should be noted that the upper side of the upper housing member 22 can have a contour other than a dome-type contour, such as a flat contour, as illustrated at FIG. 4, without departing from the scope or spirit of the present invention. It should also be noted that the upper housing member 22 does not require the shoulder 42 to remain within the scope or spirit of the present invention.

Figure 5:
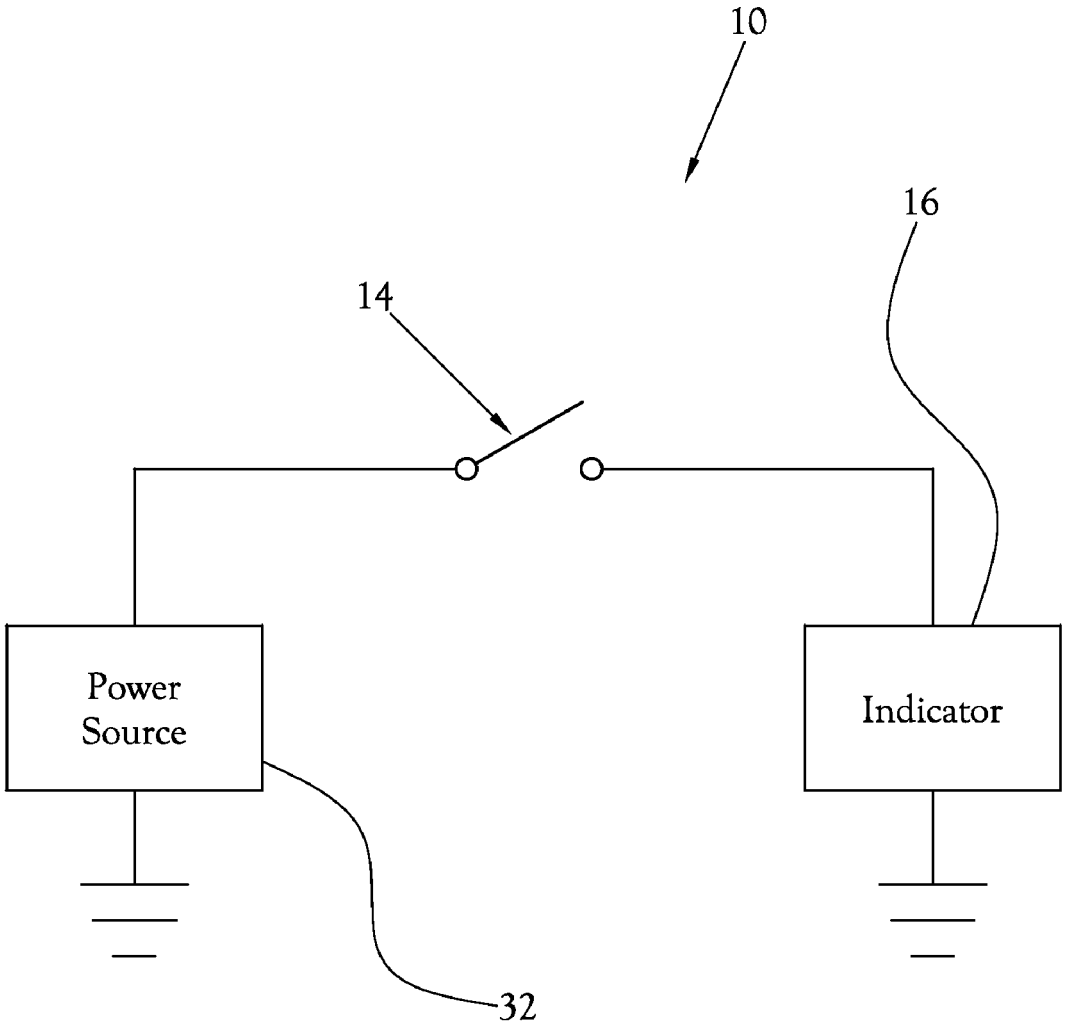
FIG. 5 is a schematic diagram of one embodiment of the swing improvement device in accordance with the various features of the present invention.

FIG. 5 is a block diagram of one embodiment of the swing improvement device 10 in accordance with the various features of the present invention. The swing improvement device 10 includes a power source 32, the pressure switch 14, and the indicator 16. The power source 32 is in electrical communication with the pressure switch 14, which is in electrical communication with the indicator 16. Stated differently, the power source 32 is in electrical communication with the indicator 16 by way of the pressure switch 14. When the pressure switch 14 is at the open position, the power source 32 is not in electrical communication with the indicator 16 such that the indicator 16 is not provided with operating power. Conversely, when the pressure switch 14 is at the closed position, the circuit is complete such that the power source 32 is in electrical communication with the indicator 16. When in electrical communication with the indicator 16, the power source 32 provides the indicator 16 with operating power such that the indicator 16 is activated. As a result, when a force sufficient to overcome the biasing force is applied to the upper housing member 22 of the pressure switch 14, the indicator 16 is activated.

When activated, the indicator 16 generates an indication that is perceivable by the golfer. For example, in one embodiment the indicator 16 generates an audible indication, such as a tone. When the indicator 16 generates an audible indication, the indicator 16 can be, for example, a piezoelectric buzzer. In one embodiment, the indicator 16 generates a visible indication, such as a flashing light. When the indicator 16 generates a visible indication, the indicator 16 can be, for example, an LED. The indicator 16 is disposed at the mat 12 such that the indication is perceivable by the golfer or at least another, such as an instructor. The indicator 16 may include a housing enclosing a battery powered circuit board to enable the LED display and/or audible speaker when the indicator 16 is activated. It is also possible to configure the indicator 16 as an output unit including an interface to communicate with an external terminal or other display device (such as a computer) via a wired or wireless transmission medium to output an indication signal to an external terminal or computer system. This would enable a coach or other person to receive, visualize, and/or record results of a golfer's swing, from a remote location or other appropriate distance from the golfer, to analyze the golf swing based on a transmitted signal from the output unit 16.

Considering the above discussion in conjunction with FIG. 2, when the golfer takes a golfer's stance on the mat 12, the golfer's front foot 18 is positioned on the upper housing member 22 of the pressure switch 14. Prior to initiating the golf swing, the golfer's body weight is substantially evenly distributed between the front foot 18 and the back foot 20. The biasing force of the biasing spring 26 is such that the force applied to the upper housing member 22 by the front foot 18 when the golfer is at this initial position is not sufficient to overcome the biasing force. As a result, when the golfer is at this initial position, the indicator 16 is not activated. When the golfer initiates the swing, the golfer first takes a back swing. As the golfer takes the back swing, the body weight of the golfer is shifted such that a majority of the golfer's body weight is at the back foot 20. As a result, when the golfer is at the top of the back swing, the indicator 16 is not activated. When the golfer performs a technically sound down swing and corresponding follow-through, the majority of the golfer's body weight shifts from the back foot 20 to the front foot 18. When this majority of body weight is shifted to the front foot 18, the body weight then supported by the front foot 18 generates a force against the upper housing member 22 of the pressure switch 14 that is sufficient to overcome the biasing force generated by the biasing spring 26. As discussed above, when the biasing force is overcome, the indicator 16 is activated such that it generates the indication. As a result, when the golfer's body weight shifts in accordance with a technically sound golf swing, the indicator 16 generates the indication. Stated differently, when the golfer performs a technically sound golf swing, the indicator 16 indicates such.

Because the body weight of one golfer can differ significantly from another, in one embodiment of the pressure switch 14, the biasing force generated by the biasing spring 26 is adjustable. More specifically, in one embodiment, the extent to which the electrodes 24 extend from the under side of the upper housing member 22 is adjustable. The more the electrodes 24 extend from the upper housing member 22, the less distance there is between the electrodes 24 and the electrical contacts 28 when no external force is applied against the upper housing member 22. As a result, the force required to overcome the biasing force, that is, the force required to move the electrodes 24 into electrical communication with the electrical contacts 28, is reduced. As a result, adjusting the position of the electrodes 24 enables the pressure switch 14 to be adjusted to accommodate golfers of various body weights. In one embodiment, the electrodes 24 are secured to the upper housing member 22 by way of cooperating threaded portions such that as each of the electrodes 24 is rotated about its longitudinal axis, the extent to which the electrode 24 extends from the upper housing member 22 is adjusted. It should be noted that the extent to which the electrodes 24 extend from the under side of the upper housing member 22 can be adjustable by ways other than the electrodes 24 having cooperating threaded portions without departing from the scope or spirit of the present invention.

In another embodiment, the pressure switch 14 is adapted such that the biasing spring 26 is readily replaceable. In this embodiment, multiple biasing springs 26 of various tensions are selectively used with the pressure switch 14 such that the tension of the currently employed biasing spring 26 governs the biasing force. As a result, the force required to move the pressure switch 14 to the closed position is adjustable in that it is based on the currently employed biasing spring 26. Stated differently, replacing the biasing spring 26 adjusts the required force exerted by the golfer to move the pressure switch 14 to the closed position such that the pressure switch 14 can be adjusted to accommodate golfers of various body weights. In the illustrated embodiment, when one of the bolts 46 is removed, the spatial relationship between the upper housing member 22 and the lower housing member 30 is such that the biasing spring 26 can be removed from and inserted within the pressure switch 14. Although, two specific embodiments of an adjustable pressure switch 14 have been discussed above, it should be noted that the biasing force generated by the biasing spring 26 can be adjustable by ways other than those discussed above without departing from the scope or spirit of the present invention.

In the illustrated embodiments of FIGS. 3 and 4, the upper housing member 22 defines at least one opening 44 adapted to receive a bolt 46 having a male threaded member. Additionally, the lower housing member 30 defines at least one nut-type structure 48 having a female threaded member adapted to cooperate with the threaded member of the bolt 46 such that the bolt 46 can be secured to the nut-type structure 48 in accordance with a conventional bolt-nut configuration. When received by the first opening 44, the bolt 46 extends therethrough and engages with the nut-type structure 48 in accordance with the above discussion. As a result, when the bolt 46 engages the nut-type structure 48, the bolt 46 can be tightened with respect to the nut-type structure 48 such that the bolt 46 and nut-type structure 48 overcome the biasing force and move the upper housing member 22 closer to the lower housing member 30, partially compressing the biasing spring 26. In doing this, the overall height of the pressure switch 14 is adjusted to accommodate, for example, the preference of the golfer or the mechanics of a given exercise.

Considering the above discussion, the golf swing improvement device 10 indicates a technically sound golf swing in a manner that is immediately and unambiguously recognizable to the golfer or another. Additionally, no component of the swing improvement device 10 is attached or tethered to the golfer such that the golfer is able to take a golf swing using the device 10 and then immediately step away from the device 10 and take a swing without using the device 10. This assists the golfer is developing lower body muscle memory.

Figure 6:
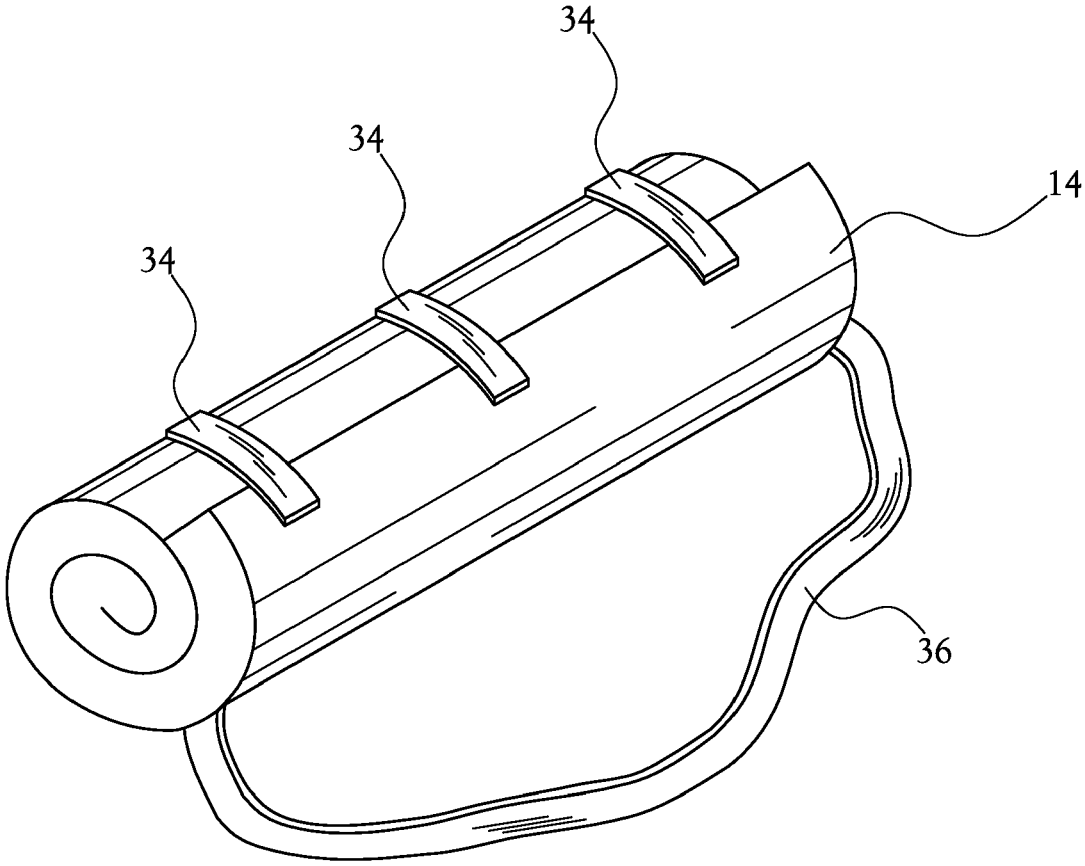
FIG. 6 illustrates the swing improvement device at a portable position.

In the illustrated embodiment, the golf swing improvement device 10 provides a portability feature. More specifically, in the illustrated embodiment, the mat 12 is capable of being manipulated to a portable position, and the swing improvement device 10 includes a mat securing apparatus 34 and a transportation apparatus 36. In the illustrated embodiment, the mat securing apparatus 34 includes a plurality of securing straps secured to a first side 38 of the mat 12. Each securing strap 34 is adapted to be removably secured to at least a portion of the under side of the mat 12. For example, on one embodiment, the securing strap 34 is removably secured to the under side of the mate 12 by way of a hook-and-loop fastener configuration. In the illustrated embodiment, the mat 12 is manipulated to the portable position by rolling the mat 12 from a second end 40, which is opposite the first end 38, to the first end 38. When the mat 12 is fully rolled, each securing strap 34 is wrapped about at least a portion of the rolled mat 12 and fastened to the under side of the mat 12, for example, using the integral hook-and-loop fastener, securing the mat 12 at the rolled, or portable, position, as illustrated at FIG. 6. When the device 10 is secured at the portable position, the device 10 can be carried using the transportation apparatus 36, which, in the illustrated embodiment, is a strap secured to the mat 12. It should be noted that the device 10 can be manually carried using the transportation apparatus 36, such as over the shoulder of the golfer, or can be attached to, for example, a golf bag. It should also be noted that the mat securing apparatus 34 and the transportation apparatus 36 can be apparatus other than those illustrated without departing from the scope or spirit of the present invention.

Figure 7:
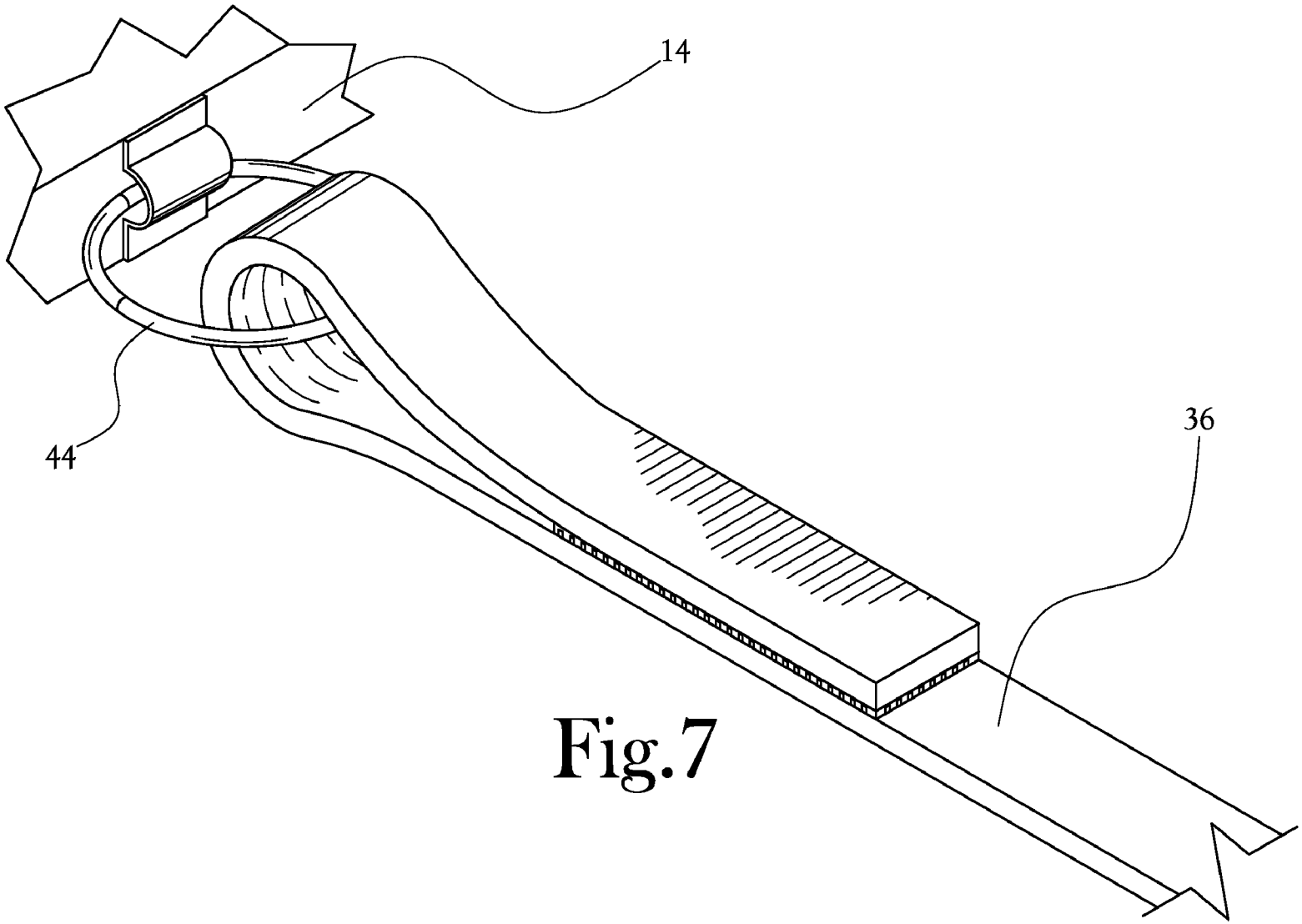
FIG. 7 illustrates an alternate embodiment of the transportation apparatus of one embodiment of the swing improvement device.

FIG. 7 illustrates an alternate embodiment of the transportation apparatus 36 in accordance with the various features of the present invention. In the alternate embodiment, the transportation apparatus 36 is removably secured to the mat 12. In the illustrated embodiment, the transportation apparatus 36 is secured to the mat 12 by way of a loop structure 44, the loop structure 44 being secured to the mat 14 and adapted to receive the transportation apparatus 36. When received by the loop structure 44, the transportation apparatus 36 is removably secured to itself, defining a loop about the loop structure 44 and removably securing the transportation apparatus 36 to the mat 12. In the illustrated embodiment, the transportation apparatus 36 is removably secured to itself using a hook-and-loop fastener configuration. However, it should be noted that the transportation apparatus 36 can be removably secured to itself by ways other than a hook-and-loop fastener without departing from the scope or spirit of the present invention.

Figure 8:
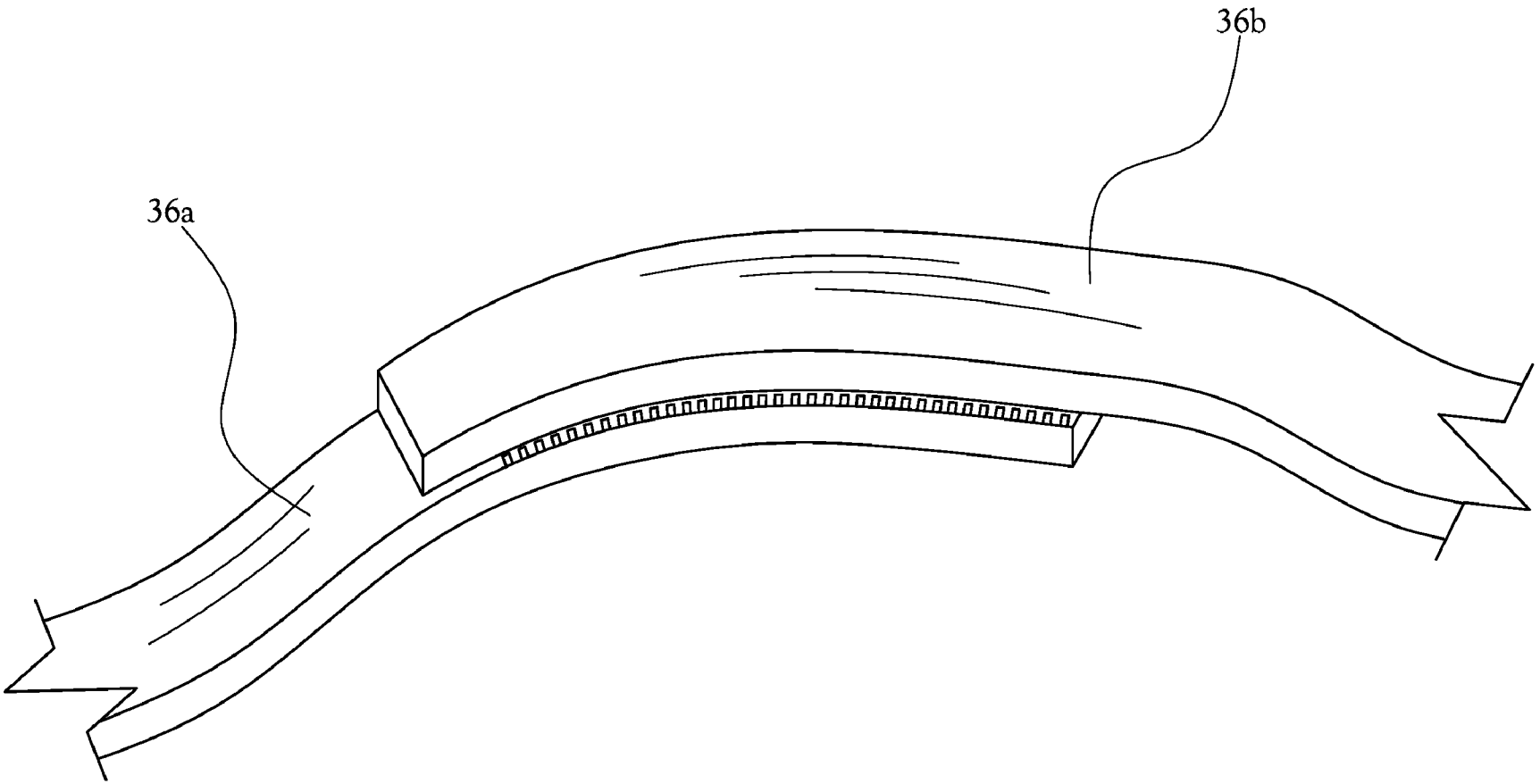
FIG. 8 illustrates another alternate embodiment of the transportation apparatus.

FIG. 8 illustrates another alternate embodiment of the transportation apparatus 36 in accordance with the various features of the present invention. In this alternate embodiment, the transportation apparatus 36 includes a first transportation apparatus member 36*a* and a second transportation apparatus member 36*b*. The first transportation apparatus member 36*a* is removably secured to the second transportation apparatus 36*b*. In the illustrated embodiment, this is accomplished using a hook-and-loop fastener configuration. However, it should be noted that the first transportation member 36*a* can be removably secured to the second transportation apparatus member 36*b* by ways other than a hook-and-loop fastener without departing from the scope or spirit of the present invention. The alternate embodiments of FIGS. 7 and 8 facilitate the swing improvement device 10 being secured to certain objects, such a golf bag.

Figure 9:
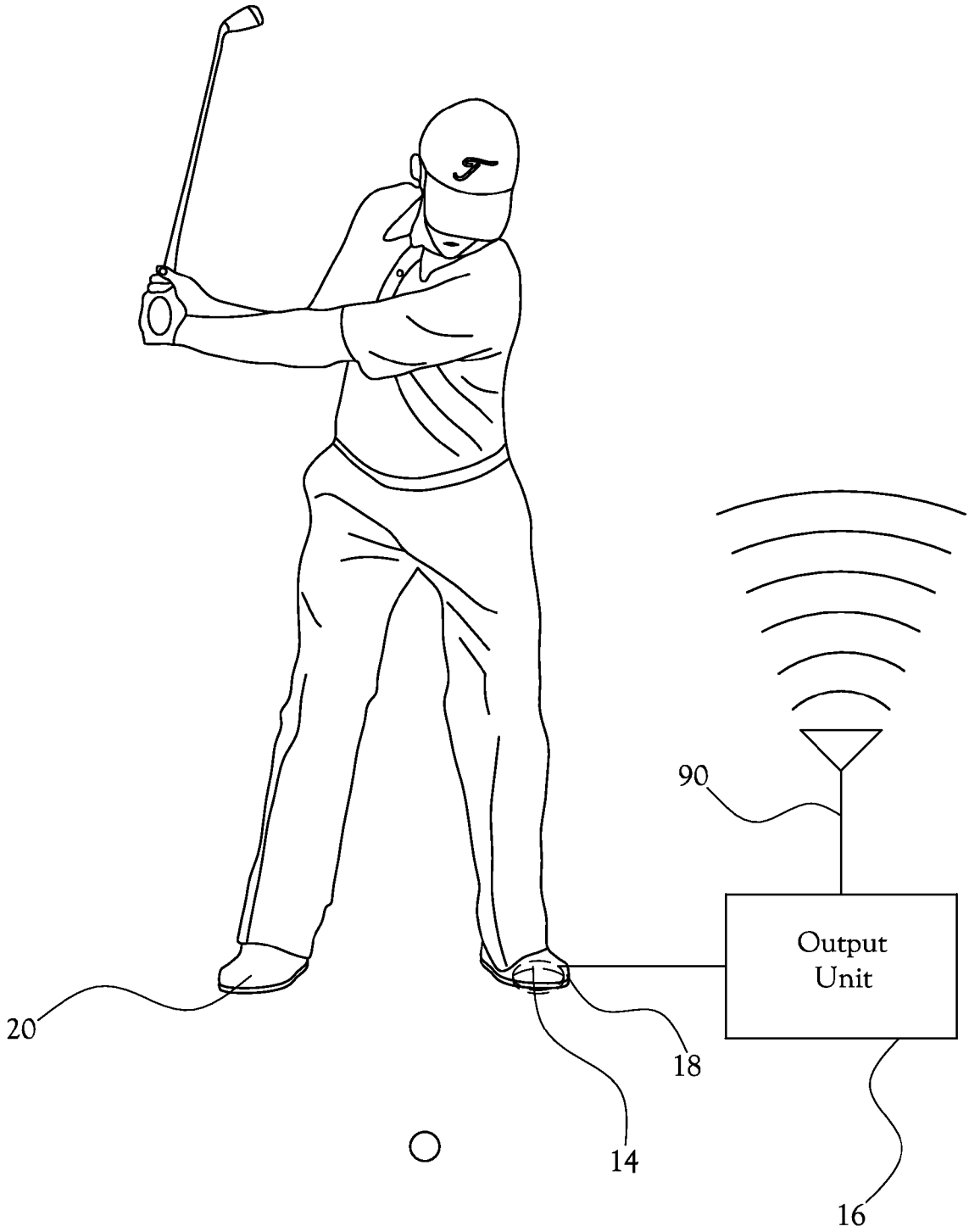
FIG. 9 illustrates a golfer performing a golf swing on a swing improvement device in accordance with another embodiment of the present general inventive concept.

As illustrated in FIG. 9, it is possible to implement a pressure switch 14 without the use of a practice mat to enable a golfer to easily transport, set-up, and use the pressure switch 14 wherever the golfer desires to practice. Moreover, as described above, it is also possible to configure the indicator 16 as an output unit to include a transmitting device 90 to communicate with an external terminal or other computer or display device (not illustrated) via a wired or wireless transmission medium to output an indication signal to an external terminal or computer system upon activation of the indicator. This would enable a coach or other person to receive, visualize, and/or record results of a golfer's swing from a remote location or other appropriate distance form the golfer based on the indication signal of the output unit 16.

Figure 10:
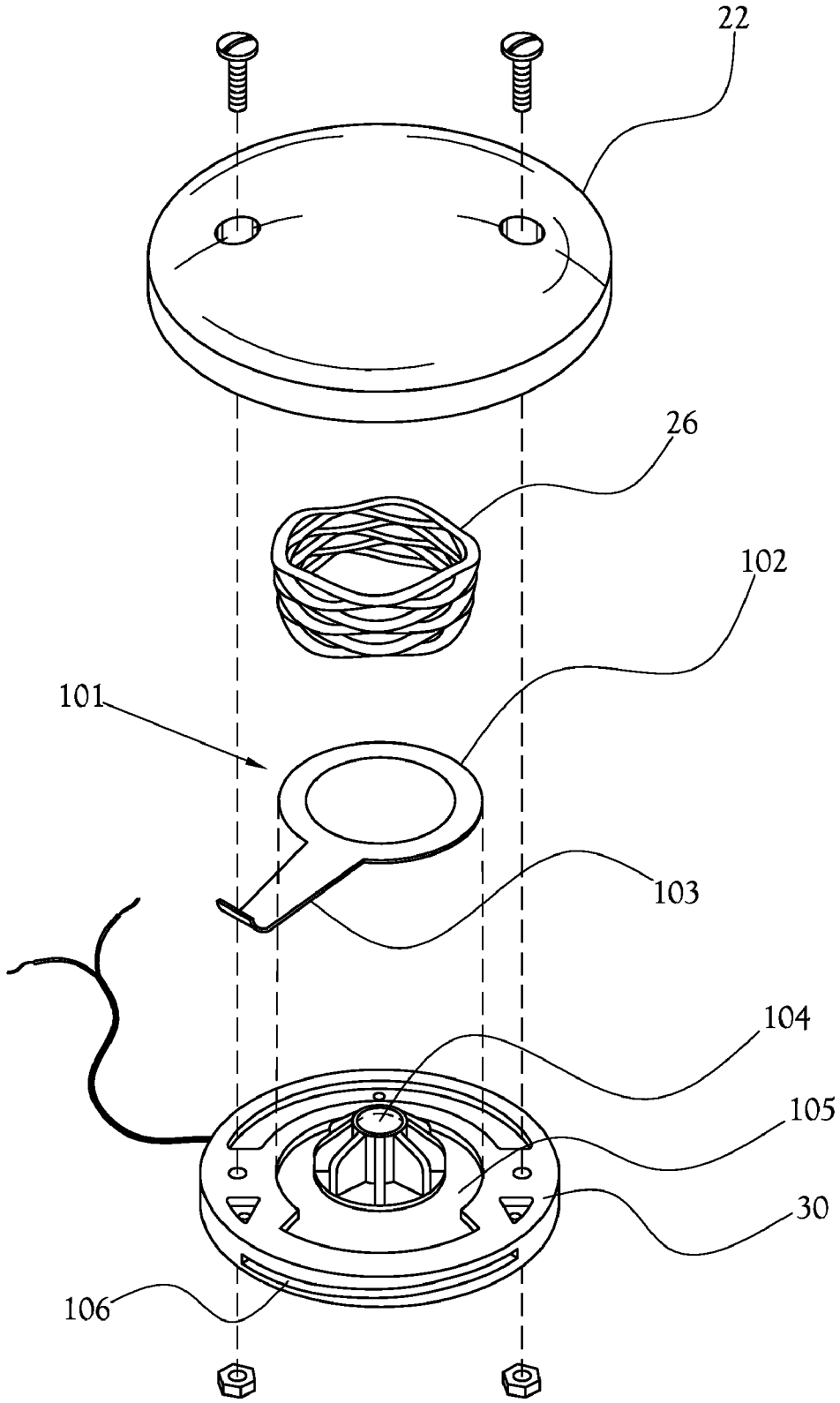
FIG. 10 illustrates a pressure switch including a spring tension adjustment lever in accordance with another embodiment of the present general inventive concept.

FIG. 10 is an exploded view of a pressure switch 14 including an adjustment lever 101 according to another example embodiment of the present general inventive concept. Referring to FIG. 10, the adjustment lever 101 can include a ring-shaped portion 102 and a lever portion 103.

Referring to FIGS. 10 to 12B, the lower housing member 30 includes a mounting surface 105 to receive the ring-shaped portion 102, and a rising channel surface 106 to receive the lever portion 103. The biasing spring 26, or compression member, can then be disposed on top of the ring-shaped portion 102 such that the ring-shaped portion supports a bottom surface of the biasing spring 26 at a predetermined height between the upper housing 22 and the lower housing 30, as illustrated in FIGS. 11A and 11B.

Figure 11A:
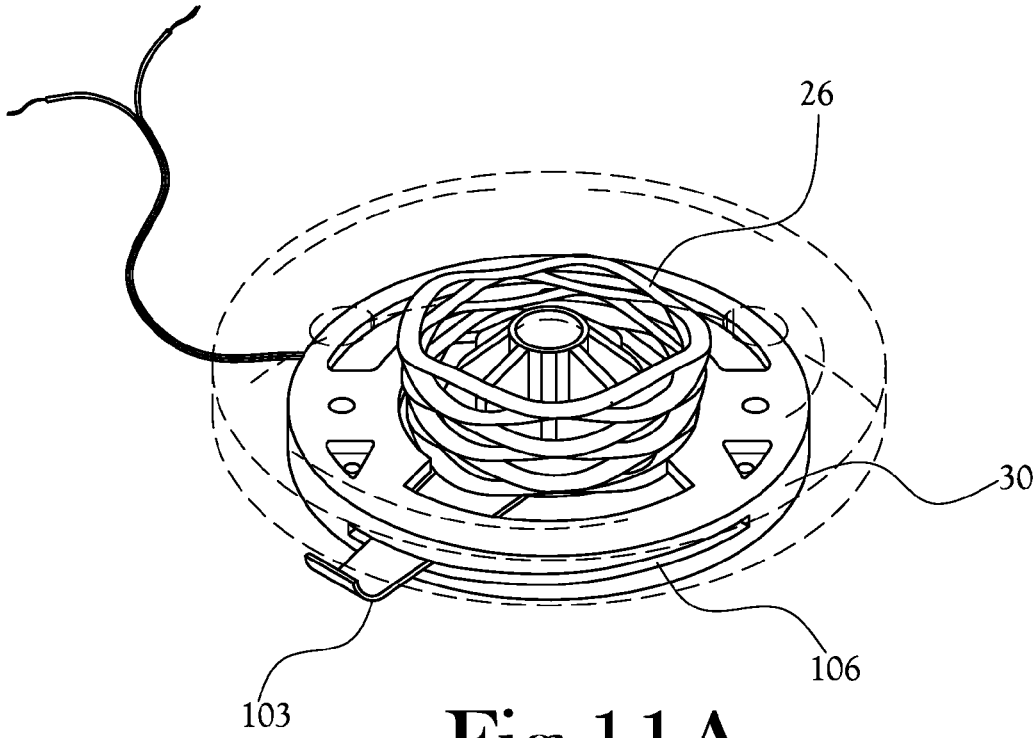
FIGS. 11A to 12B illustrate an exemplary operation of the spring tension adjustment lever of FIG. 10.
Figure 11B:
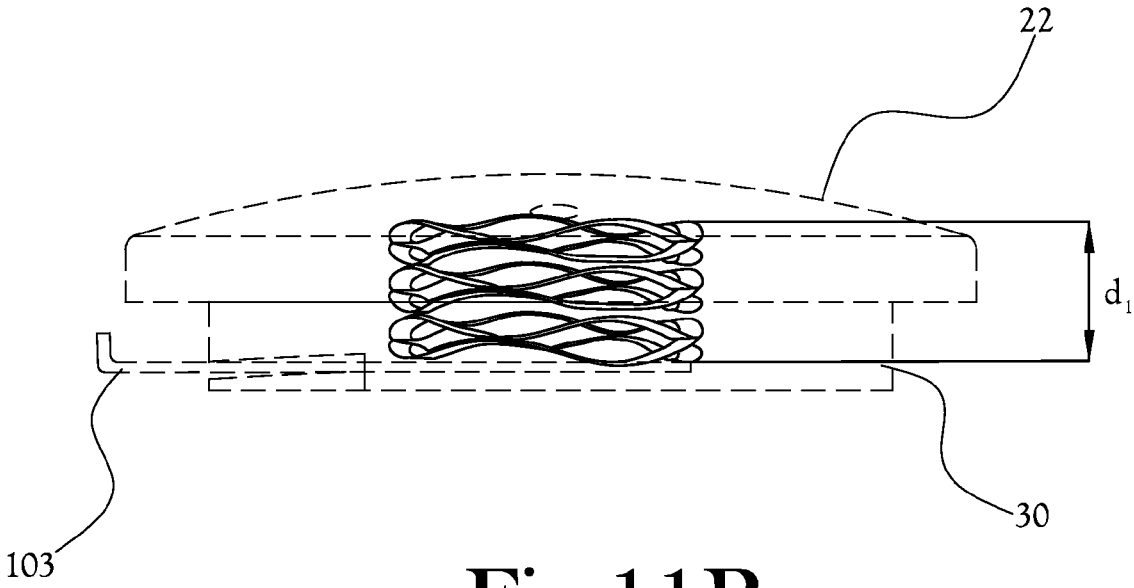

For example, referring to FIGS. 11A and 11B, when the upper housing member 22 is mounted to the lower housing member 30 and the lever portion 103 is positioned at a first end of the channel surface 106 (e.g., left end of channel 106 in FIG. 11A), the ring-shaped portion is positioned to support a bottom surface of the biasing spring 26 at a first height $d_1$ between the upper housing 26, thus providing a first biasing force between the upper housing member 22 and the lower housing member 30. The first biasing force can correspond to a first body weight of a particular golfer such the first biasing force is sufficient to withstand a first pressure from the golfer's front foot to prevent activation of the contact switch during initiation of the golf swing, but when the golfer's body weight shifts during the down swing, the biasing force is overcome by the additional pressure transferred to golfer's front foot in accordance with a proper golf swing, thus enabling activation of the contact switch. In other words, when the majority of body weight of the golfer is shifted to the front foot 18 from the back foot according to a technically sound golf swing, the first biasing force can be overcome to activate the switch 104 and generate the indicator signal. Those skilled in the art will appreciate that the switch 104 can be any known or later developed switch chosen with sound engineering judgment to interact with linear and/or arcuate movement of the upper housing member 22 with respect to the lower housing member 30 to activate the switch 104 to generate an indication signal. For example, the switch 104 could be a momentary-on or membrane switch, but the switch 104 is not limited to any particular type of switch.

Figure 12A:
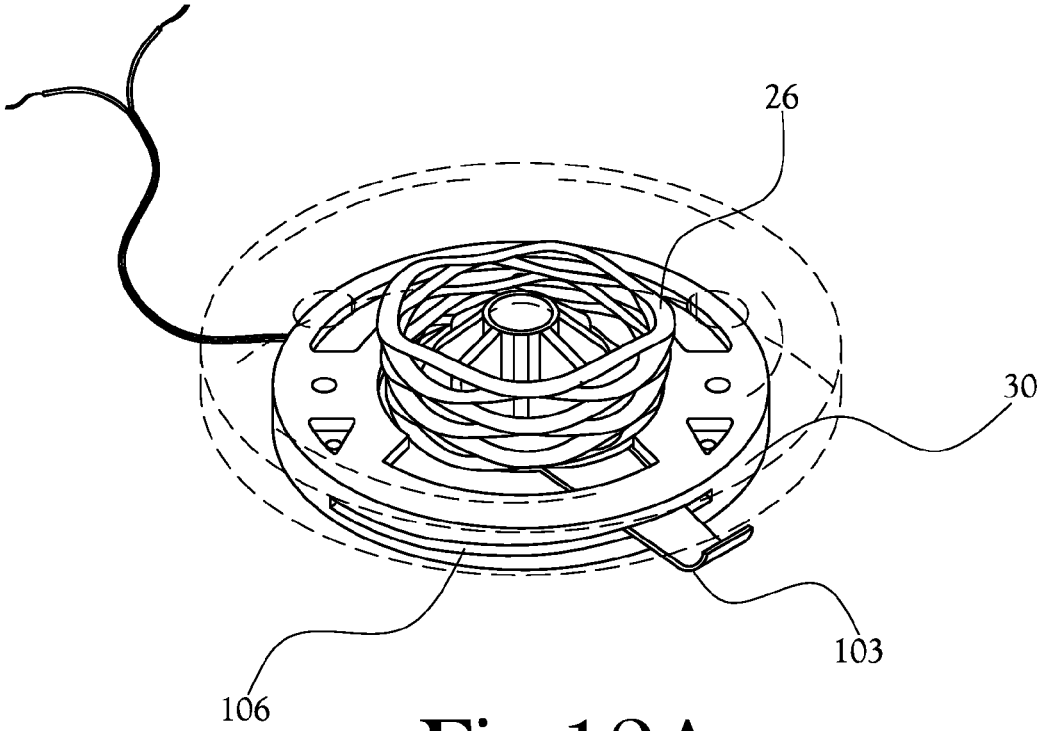
Figure 12B:
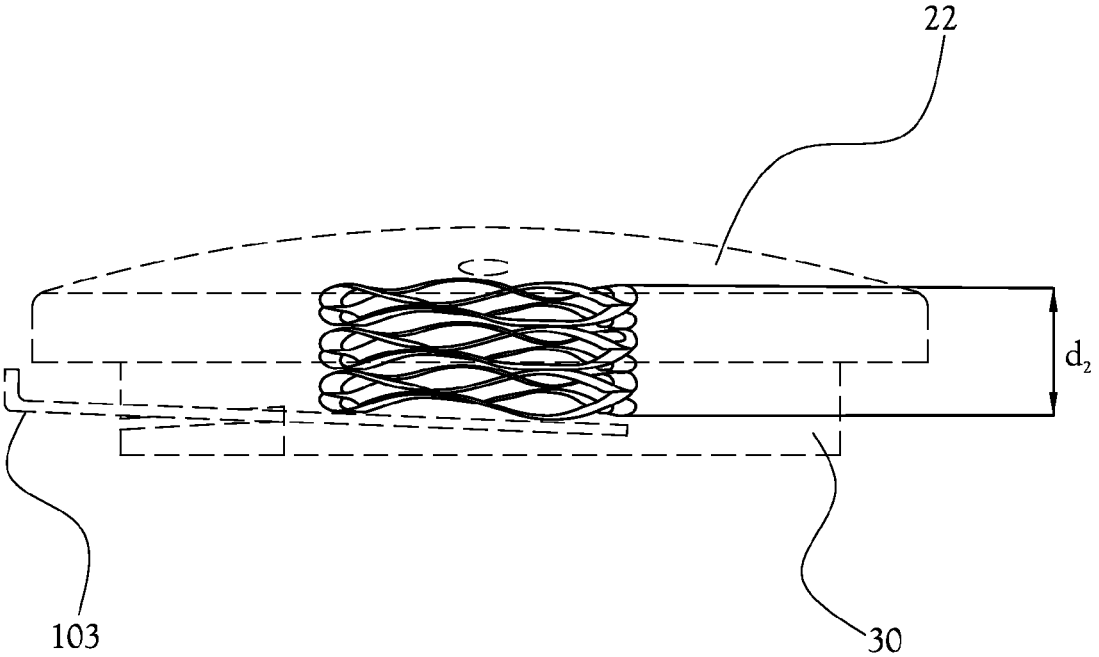

Referring to FIGS. 12A and 12B, it is possible to increase the biasing force of the spring 26 by moving the lever 103 toward the upper side of the channel surface 106 (e.g., right hand side of channel 106 in FIG. 12A), thus pre-loading the biasing spring 26 to a second height $d_2$ less than the first height $d_1$ to increase the biasing force necessary to activate the switch 104. In this example embodiment, since the channel surface 106 is tapered, when the lever portion 103 is moved from left to right along the channel surface 106, the lever portion 103 gradually rises along the rising tapered channel surface 106 to provide an increasing tension to a portion of the bottom surface of the spring 26 (i.e., decreasing the height of the spring from $d_1$ to $d_2$), thus increasing the biasing force necessary to activate the switch 104 during a proper golf swing.

In this configuration, the ring-shaped portion of the adjustment lever supports a bottom surface of the compression member such that when the adjustment lever is positioned at one end of the tapered surface, the ring-shaped portion supports the bottom surface of the compression member at a first height between the upper housing and the lower housing to define a first biasing force, and when the adjustment lever is positioned at another end of the tapered surface, the ring-shaped portion elevates at least a portion of the bottom surface of the compression member to a second height between the upper housing and the lower housing to define a second biasing force greater than the first biasing force. Such adjustment mechanism enables the pressure switch 14 to be easily adjusted to accommodate various swing pressures and/or body weights associated with different golfers. It is noted that many other types and configurations of adjustment mechanisms, in addition to the mechanisms illustrated and described herein, could be used to adjust the biasing force of the pressure switch, without departing from the broader principles of the present general inventive concept.

Figure 13A:
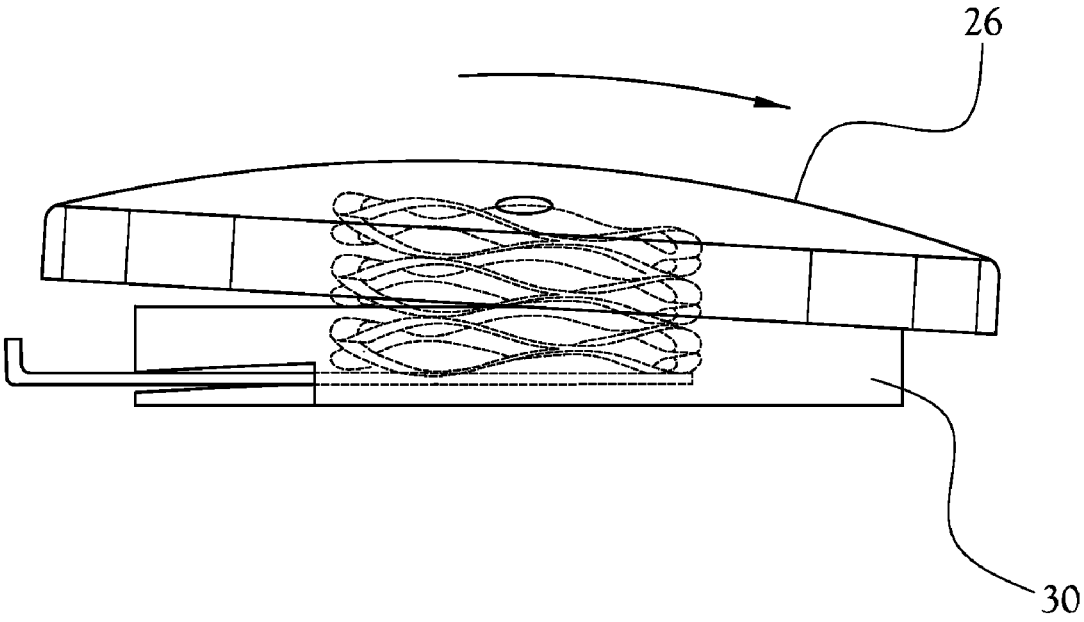
FIGS. 13A and 13B illustrate an exemplary operation of the pressure switch according an embodiment of the present general inventive concept.
Figure 13B:
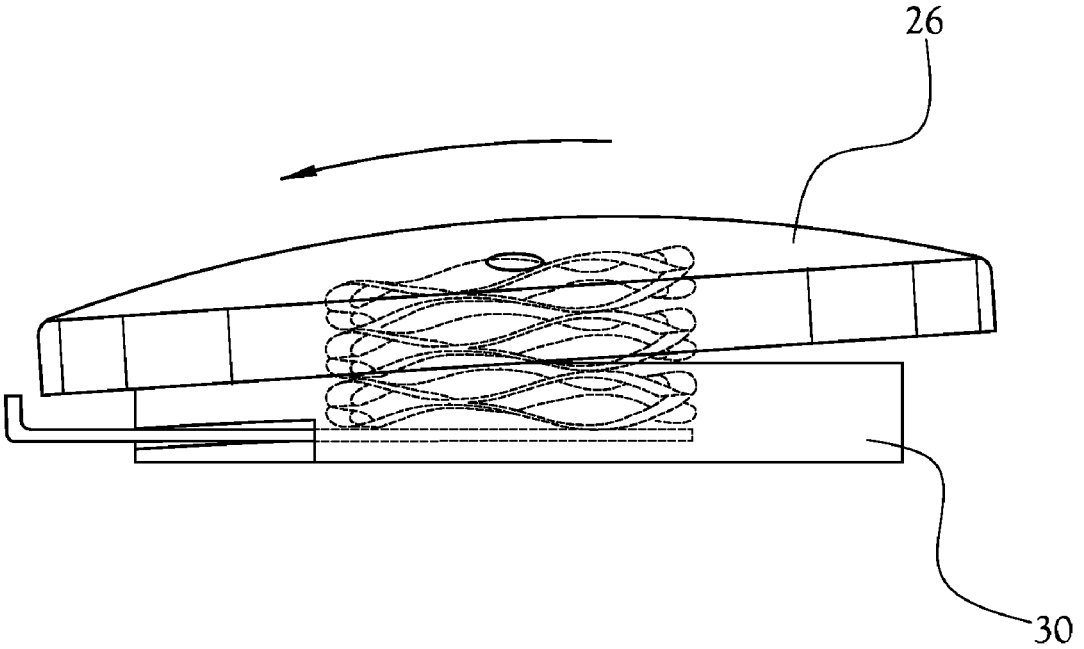

FIGS. 13A and 13B illustrate exemplary arcuate motion, i.e., rocking motion, of the upper housing member 22 according an example embodiment of the present general inventive concept. In this embodiment, in addition to linear (i.e., upward-downward) motion of the upper housing member 22 with respect to the lower housing member 30 when the golfer's foot applies pressure to the pressure switch 14, the pressure switch 14 can be responsive to compressive arcuate motion (i.e., rocking motion) of the upper housing member 22 with respect to the lower housing member 30. To facilitate this arcuate movement, the upper side of the upper housing member 22 can have a dome-type contour to comfortably accommodate the pivoting movement of the golfer's front foot provided during a technically sound golf swing. This configuration also advantageously maintains a low profile for the pressure switch 14, to minimize interference with the golfer's natural movements.

Figure 14:
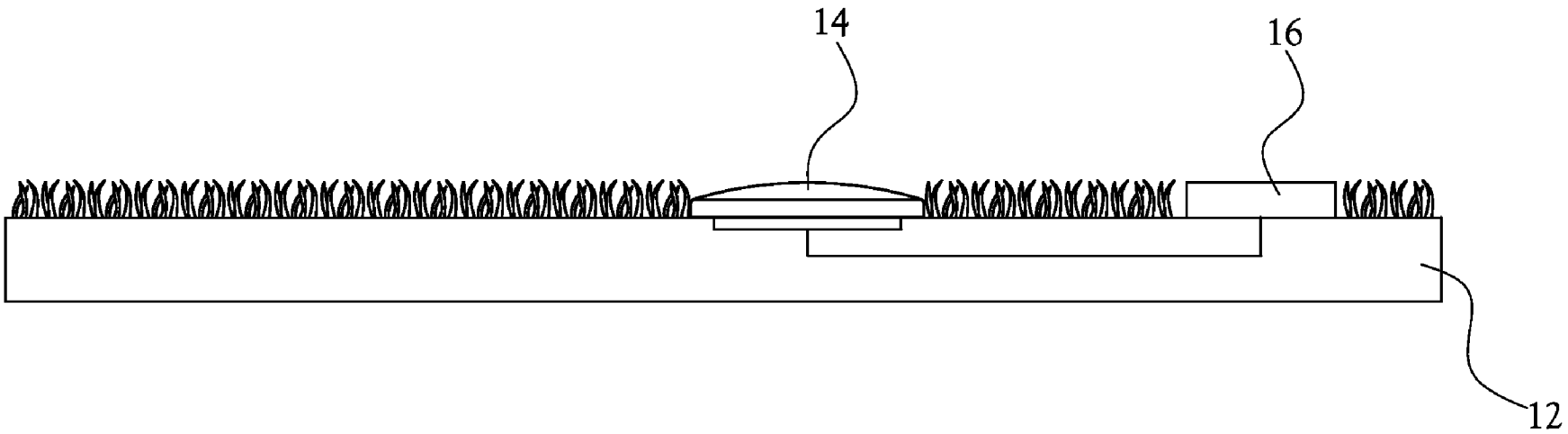
FIG. 14 is a front view illustrating a low profile of the pressure switch and output unit according to an example embodiment of the present general inventive concept.

FIG. 14 illustrates an exemplary configuration where the pressure switch 14, indicator 16, and associated wiring are embedded into the top surface of the mat 12, to provide a low profile for the pressure switch 14 when the device is used with the optional mat 12. The top surface of the mat 12 can include an artificial grass structure. A recess can be formed in the artificial grass structure to accommodate the pressure switch 14 and indicator 16 for convenience of assembly, and to maintain a low profile of the pressure switch 14 under the golfer's foot.

Referring to FIGS. 13A and 13B, the spring 26 can be a wave spring to facilitate rocking motion of the upper housing member 22 to activate the switch 104 as the golfer's foot rolls and/or pivots according to weight shift during a proper golf swing. Those skilled in the art will appreciate that wave springs operate as load bearing devices to take up play and compensate for dimensional variations within assemblies. A range of forces can be applied to the spring whereby loads build either gradually or abruptly to reach a predetermined working height. This establishes a predetermined spring rate in which load is proportional to deflection. The working height of the spring 26 can be adjusted to change the biasing force of the spring, and a variety of forces associated with a golfer's weight shift can be translated from the golfer's foot to the spring 26 to facilitate accurate and consistent activation of switch 104 during a technically sound golf swing.

From the foregoing description, those skilled in the art will recognize that a golf swing improvement device for indicating the proper shift of a golfer's body weight to the front foot during a down swing offering advantages over the prior art has been provided. More specifically, the swing improvement device measures the shift of the golfer's body weight during a golf swing and indicates when such shift is in accordance with a technically sound swing. Additionally, the swing improvement device is self-sufficient and portable such that the device is deployable almost anywhere. The swing improvement device also provides swing analysis in a manner that is immediately understandable to the golfer.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A golf swing improvement device to indicate a shift of a golfer's body weight during a golf swing, comprising:

a lower housing having an opening disposed through a peripheral surface thereof;

an upper housing movably coupled to the lower housing to receive the golfer's front foot;

a contact switch disposed between the upper housing and the lower housing such that the contact switch is activated upon a predetermined compression of the upper housing with respect to the lower housing;

a compression member disposed between the upper housing and the lower housing to create a biasing force between the upper housing and the lower housing such that when the golfer initiates the golf swing, the biasing force withstands a first pressure from the golfer's front foot to prevent activation of the contact switch, and when the golfer's body weight shifts during a down swing, the biasing force is overcome by a second pressure from the golfer's front foot, greater than the first pressure, to enable activation of the contact switch; and an adjustment lever movably disposed within the opening to contact the compression member such that the biasing force is changed when the adjustment lever is moved within the opening.

2. The golf swing improvement device of claim 1, wherein the adjustment lever comprises a ring-shaped portion to support a bottom surface of the compression member and the opening comprises an elongated tapered surface such that when the adjustment lever is positioned at one end of the tapered surface, the ring-shaped portion supports the bottom surface of the compression member at a first height between the upper housing and the lower housing to define a first biasing force, and when the adjustment lever is positioned at another end of the tapered surface, the ring-shaped portion elevates a portion of the bottom surface of the compression member to a second height between the upper housing and the lower housing to define a second biasing force greater than the first biasing force.

3. The golf swing improvement device of claim 1, further comprising:

an output unit connected to the contact switch to output an indication signal when the contact switch is activated.

4. The golf swing improvement device of claim 1, further comprising a practice mat having a recess formed therein to receive the lower housing and the upper housing such that an upper surface of the upper housing is substantially coplanar to a top surface of the practice mat when the lower housing and the upper housing are installed in the recess.

5. The golf swing improvement device of claim 1 wherein the contact switch is a membrane switch to be activated upon compression of the upper housing with respect to the lower housing.

6. The golf swing improvement device of claim 1, wherein the predetermined compression of the upper housing with respect to the lower housing is achieved by arcuate motion and/or linear motion of the upper housing with respect to the lower housing.

7. The golf swing improvement device of claim 1 wherein the contact switch is a momentary-on switch to be activated upon compression of the upper housing with respect to the lower housing.

* * * * *